US006557718B1

(12) United States Patent
Cesano

(10) Patent No.: US 6,557,718 B1
(45) Date of Patent: May 6, 2003

(54) SUPERIMPOSABLE AND INTERPENETRABLE PLASTICS BOX

(75) Inventor: Franco Cesano, Bricherasio (IT)

(73) Assignee: Sicav Sas Di Militemi & Co., Turin (IT)

( * ) Notice: Subject to any disclaimer, the term of this patent is extended or adjusted under 35 U.S.C. 154(b) by 0 days.

(21) Appl. No.: 09/673,551

(22) PCT Filed: Apr. 7, 1999

(86) PCT No.: PCT/EP99/02368

§ 371 (c)(1),
(2), (4) Date: Oct. 13, 2000

(87) PCT Pub. No.: WO99/52781

PCT Pub. Date: Oct. 21, 1999

(30) Foreign Application Priority Data

Apr. 15, 1998 (IT) ..... TO98A0322

(51) Int. Cl.[7] ..... B65D 21/00
(52) U.S. Cl. ..... 220/518; 220/505; 220/507
(58) Field of Search ..... 220/505, 507, 220/518, 519

(56) References Cited

U.S. PATENT DOCUMENTS

| | | | | |
|---|---|---|---|---|
| 5,035,326 A | * | 7/1991 | Stahl | 206/505 |
| 5,287,966 A | * | 2/1994 | Stahl | 206/507 X |
| 5,372,257 A | * | 12/1994 | Beauchamp et al. | 206/505 X |
| 5,752,602 A | * | 5/1998 | Ackermann et al. | 206/507 |
| 5,881,902 A | * | 3/1999 | Ackermann | 206/507 X |
| 5,896,992 A | * | 4/1999 | McGrath | 206/505 X |

* cited by examiner

*Primary Examiner*—Steven Pollard
(74) *Attorney, Agent, or Firm*—TraskBritt

(57) ABSTRACT

A box of plastics material, comprising a bottom wall (22) having a rectangular shape, from which a pair of longer lateral walls (28) and a pair of shorter lateral walls (24, 6) project. The box comprises a first and a second pair of support elements, in which the support elements of the first pair are arranged along a first lateral wall (24) and the support elements of the second pair are arranged along respective lateral walls (28) orthogonal with respect to the first wall. The support elements are arranged so that the box can be interpenetrated with a box of the same type when the two boxes have the same relative orientation and can be superimposed to a box of the same type when the two boxes have an opposite relative orientation.

9 Claims, 5 Drawing Sheets

SUPERIMPOSABLE AND INTERPENETRABLE PLASTICS BOX

Figure 1:
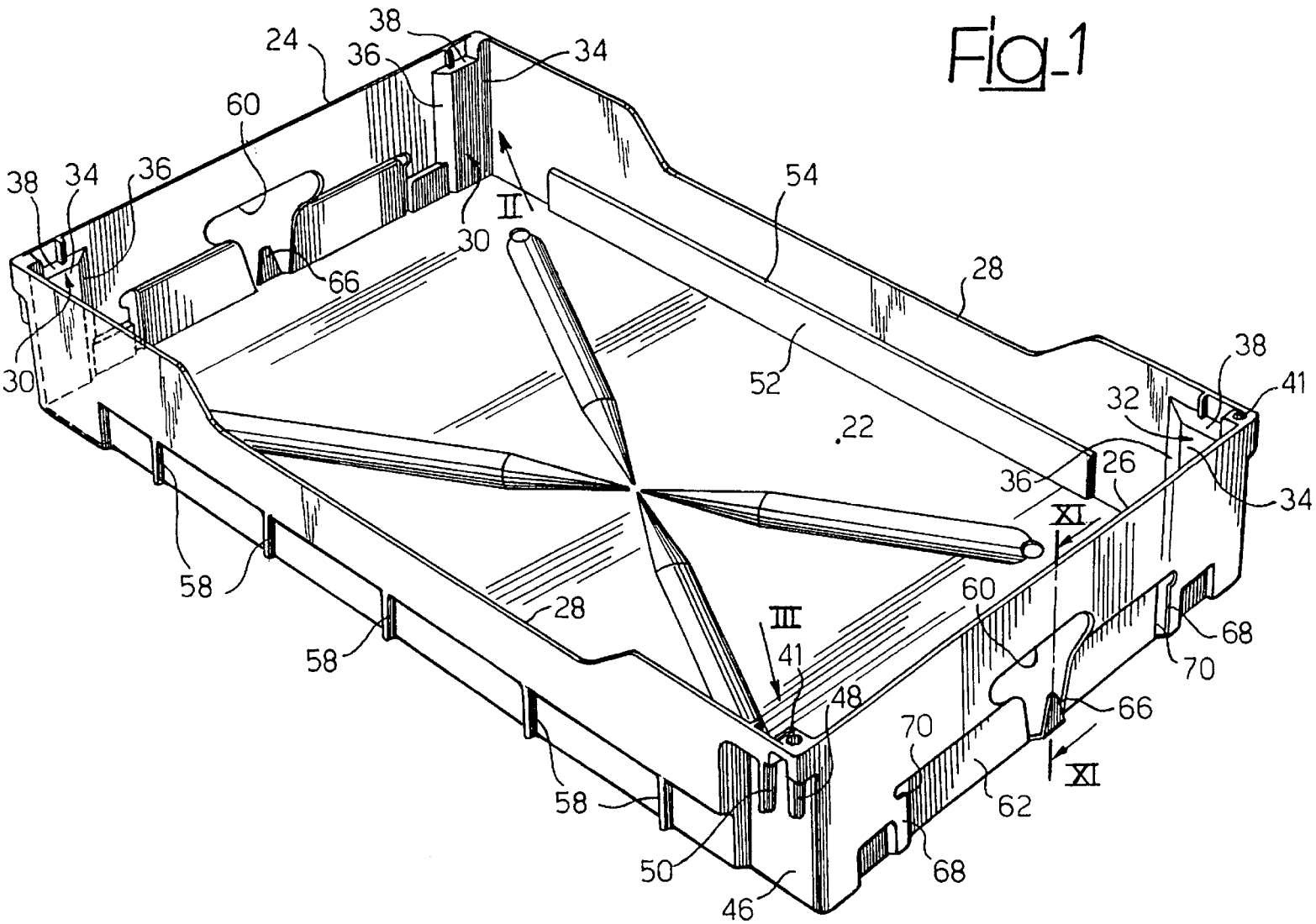

The present invention relates to a box of plastics material of the type comprising a bottom wall with a rectangular shape and four lateral walls projecting therefrom.

The present invention has been developed with the specific object providing a box adapted to contain fruit. Fruit boxes have standard dimensions of 600×400 mm and are intended to receive on their bottom wall a cell-like element also having standard dimensions and provided with seats which keep separated from each other the various pieces of fruit. In order to be usable for containing fruit, the boxes must have inner dimensions consistent with those of the standard cell-like elements, which are close to the outer dimensions of the boxes. The standardized cell-like elements are specifically formed for containing fruit with defined shape, dimensions and weight. Such elements are standardized on the basis of wood or cardboard boxes already existing on the market which have defined outer dimensions and inner dimensions which differ from the outer ones only for the thickness of the material (wood or cardboard).

In many countries the great majority of fruit is transported into wood or cardboard boxes which are generally disposed after the first use. Disposable cardboard or wood boxes do not comply with recent anti-pollution provisions which impose the use of boxes which can be utilized several times and can be washed after each use.

Re-usable boxes must be carried from the point of sale to a washing centre and after washing must be carried to the production place where they are filled with a new fruit load. Boxes for this type of use must have overall dimensions as low as possible when they are empty, in order to reduce the cost of transportation which represents a relevant part of the total cost of the operations necessary for rendering re-usable the boxes.

A box which meets the above needs and has dimensions consistent with those of standard cell-like elements is known. This box has four lateral walls hinged to the bottom wall and which can be locked in upright position. After use, the lateral wall can be brought down for reducing dimensions during transportation. This box must have relative stout and resistant walls in order to provide an efficient locking thereof in upright position and this is obtained by using a reticular structure with numerous intersecting stiffening ribs both for the bottom wall and the lateral walls.

A box of this type has several drawbacks, the most relevant of which is the fact that it is subject to breakage after repeated assembly and disassembly operations. Furthermore, it is difficult to wash the reticular structure of the box, which has also relatively high weight and cost.

EP-A-0573729 of the same inventor of the present application, discloses a plastic collapsible box provided with removable uprights which have the purpose of the maintaining the lateral walls in a raised position. This box is simpler and less expensive than a box with reticular structure having a snap engagement locking system between the walls, but has the drawback of requiring relevant manpower for assembling and disassembling operations.

DE7435329U discloses a plastic box having the features contained in the preamble of claim 1, comprising a first pair of support elements arranged along a first lateral wall and a second pair of support elements arranged along respective lateral walls orthogonal to the first wall. Boxes of this type can be superimposed to each other when they are alternatively placed with opposite relative orientation and can be interpenetrated (so as to reduce the overall dimensions) when they are placed with the same relative orientation. However, boxes of the type disclosed in DE7435329 have dimensions which are not consistent with the use of standard cell-like elements for containing fruit. Even if the inner dimensions of these boxes where varied so as to receive such cell-like elements, their outer overall dimensions would exceed the maximum outer dimensions which are accepted for fruit boxes because of the dimensions of the system which permits the boxes to be superimposed or interpenetrated. In addition when a plurality of boxes in accordance with DE7435329 are stacked, there are substantial risks of instability of the stack because there is no lateral interpenetration between the boxes.

In order to solve the above problems, the subject of the present invention is a plastics box having the features forming the subject of the main claim.

The present invention provides a superimposable and interpenetrable box having outer dimensions substantially identical to the ones of standard wood or cardboard fruit boxes and with an inner room which can receive the standard cell-like elements. Such cell-like elements are formed so as to avoid that the fruit interferes with the corners of the box where uprights with triangular cross-section are normally located. The invention provides a system which permits the boxes to be superimposed or interpenetrated, which utilizes only the room which in the wood or cardboard boxes is occupied by the triangular uprights.

Figure 2:
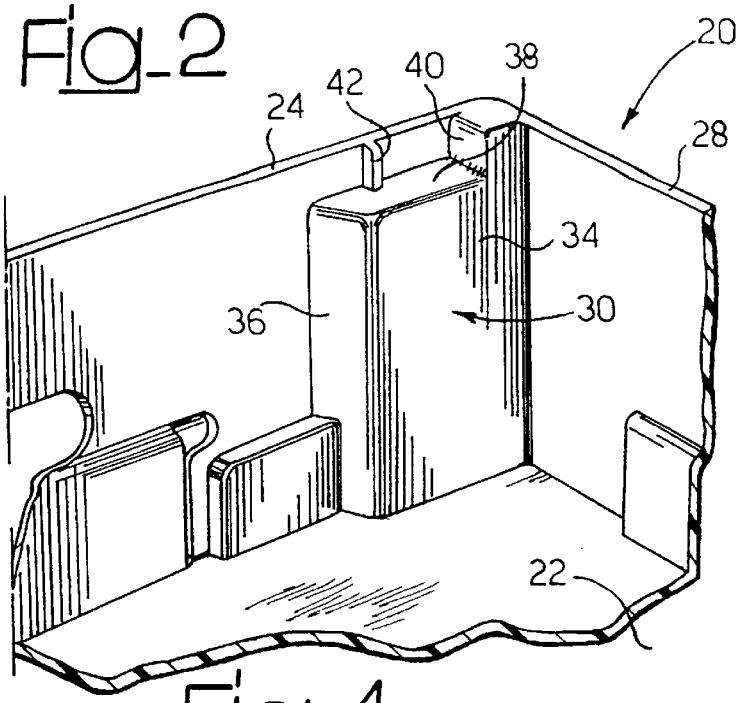
Figure 11:
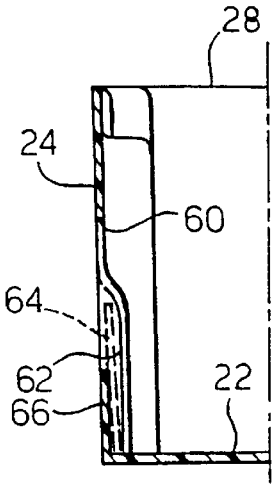
Figure 4:
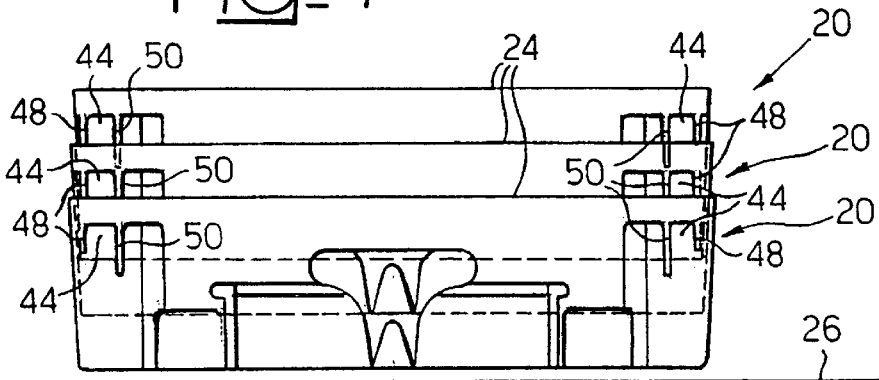
Figure 8:
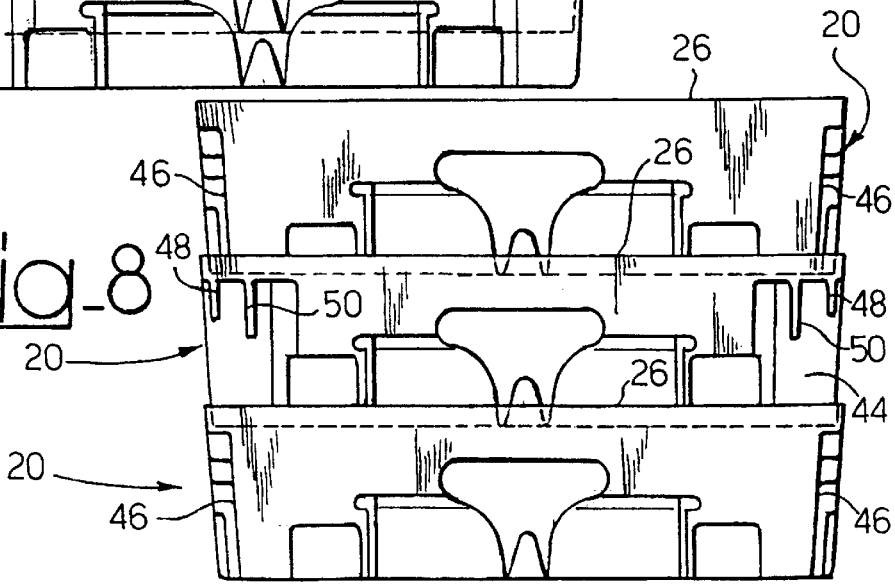
Figure 3:
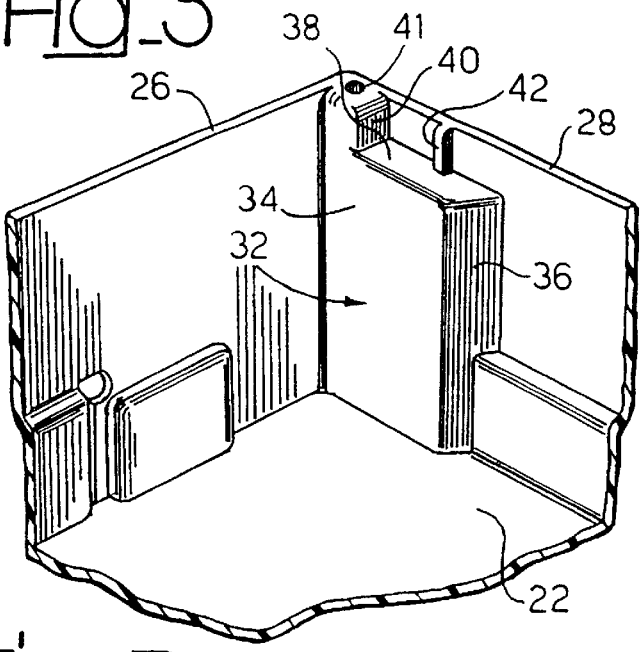
Figure 7:
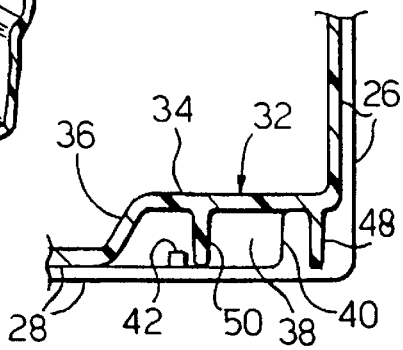
Figure 5:
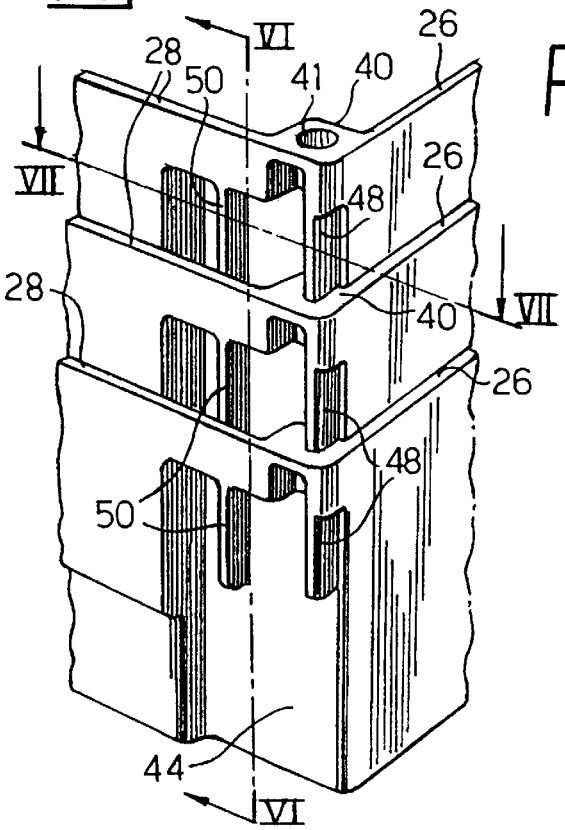
Figure 6:
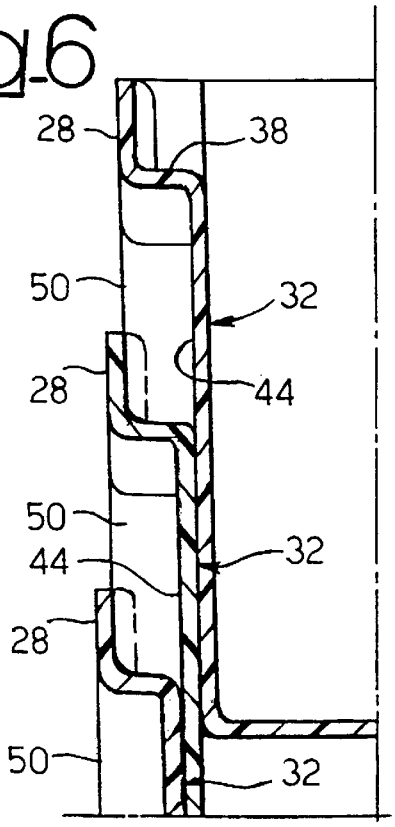
Figure 9:
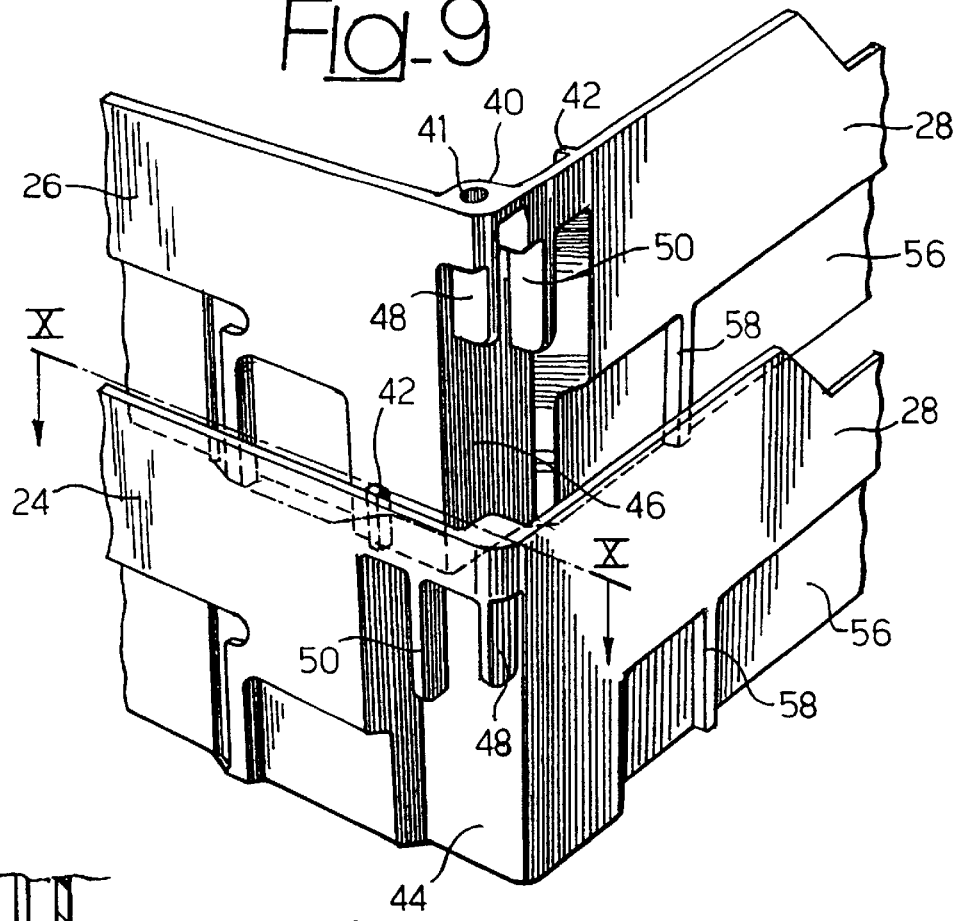
Figure 10:
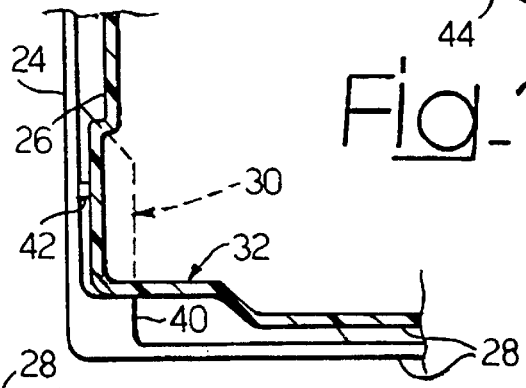
Figure 12:
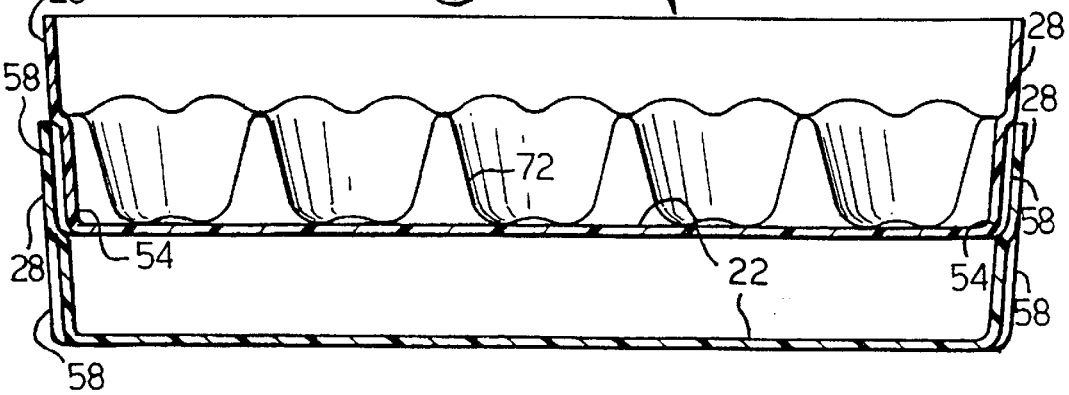
Figure 13:
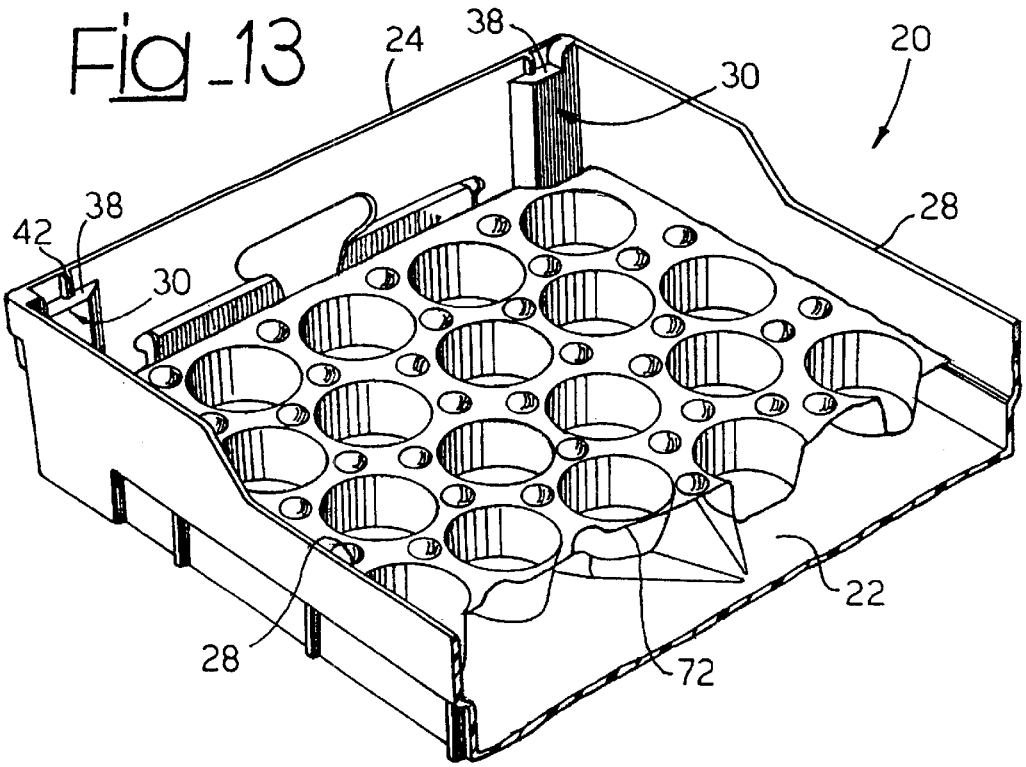
Figure 14:
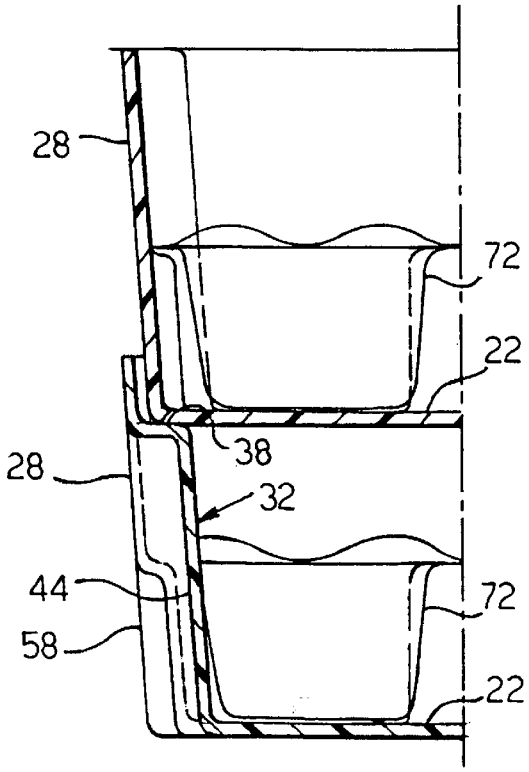

The box according to the invention now will be disclosed in detail with reference to the attached drawings, given purely by way of non-limiting example, in which:

FIG. 1 is a perspective view of a box according to the invention,

FIGS. 2 and 3 are partial perspective views along arrows II and III of FIG. 1, FIG. 4 is a front elevational view showing some boxes according to the present invention in a interpenetrated position, FIG. 5 is a partial perspective view showing a detail of the interpenetrated boxes, FIGS. 6 and 7 are cross-sections taken on the lines VI—VI and VII—VII of FIG. 5, FIG. 8 is a front elevational view showing some boxes according to the invention in a superimposed position, FIG. 9 is a perspective view showing a detail of the superimposed boxes, FIG. 10 is a section taken on the line X—X of FIG. 9, FIG. 11 is a section taken on the line XI—XI of FIG. 1, FIG. 12 is a cross-section showing two interpenetrated boxes, FIG. 13 is a partial perspective view showing a box according to the invention provided with a sell-like element for containing the fruit, and FIG. 14 is a partial cross-section showing two superposed boxes provided with respective cell-like elements.

With reference to the drawings, a box intended in particular to be used for carrying fruit is indicated 20. The box 20 is made of plastics material and is formed in a single piece by a method per se known of low pressure moulding or injection moulding.

The box 20 has a bottom wall 22 with a rectangular shape from which two shorter lateral walls 24, 26 and two longer lateral walls project. The lateral walls 24, 26 and 28 are outwardly sloped with respect to a plane orthogonal to the bottom wall 22. The slope of the lateral walls can be comprised between 2–4° and has essentially the purpose of enabling the boxes 20 to be inserted one within the other as it will be disclosed in detail in the following.

The box 20 has four support elements arranged in correspondence with the corners formed by each pair of adjacent walls 24, 26, 28. A first pair of support elements 30 is arranged along the shorter lateral wall 24. The support elements 22 of a second pair are arranged along the longer lateral walls 28. Each support element 30, 32 is essentially formed by a shaped portion of the respective wall 24, 28 having a thickness substantially equal to the thickness of the remaining part of the wall 24, 28. Each support element 30, 32 has a flat wall 34 extending along a plane substantially parallel to the respective wall 24, 28 and connected to the latter by means of a sloped wall 36. Each support element 30, 32 has also a flat elongated bearing surface 38 extending in a direction parallel to the wall 24, 28 from which the support element projects. The surfaces 38 of the individual support elements 30, 32 are coplanar to each other and parallel to the bottom wall 22. Each support element 30 has also a centring portion 40 upwardly projecting from the respective bearing surface 38 and integrally formed with the walls 24 and 28. A centring rib 42 projects from the wall 24, 28 and extends upwardly starting from the bearing surface 38 of each support element 30.

Recessed portions 44, 46 are formed on the outer surface of the walls 24, 28 in correspondence with the support elements 30, 32 and have a shape corresponding to that of the support elements. In a practical embodiment, since the support elements 30, 32 are simply formed by an inwardly shaped portion of the wall 24, the recessed portions 44, 46 are simply formed by the empty zones which are left on the outer side of the walls 24, 28 by the inward deformation which forms the support elements 30, 32. Two ribs 48, 50 with different lengths and parallel to each other are formed in correspondence with each recessed portion 44, 46 and their function will become clear in the following of the description.

Respective inwardly projecting portions 52 having an upper bearing edge 54 are formed along the longer lateral walls 28. In correspondence with the projecting portions 52, the longer lateral walls 28 have respective recessed portions 56 on their inner side, in correspondence of which ribs 58 are formed whose bottom end is intended to bear on the edge 54 of the inwardly projecting portions 52 of another box.

Respective through apertures 60 are formed on the shorter lateral walls 24, 26 and have dimensions sufficient for receiving a hand, in order to facilitate the grip for hoisting the box. On the outer side of the shorter lateral walls 24, 26 recessed seats 62 are also formed, which are adapted to receive and hold a label 64 (FIG. 11) on which information are printed relating to the type of product contained in the box. The label 64 is kept by a central projection 66 placed in correspondence with the aperture 60 and by two lateral projections 68 formed by slots 70 extending across the lateral edge of the recessed portions 62. The seat for the label is formed so that the label falls spontaneously when the box is turned over.

In its version intended to contain fruit, the box 20 has outer dimensions of 600×400 mm, lateral walls with a height of about 110 mm and uniform wall thickness of about 2–2.5 mm. A box according to the invention having these outer dimensions, which are the standard outer dimensions of fruit boxes, can receive a cell-like element 72 with standard dimensions, of the type normally used with cardboard, wood or collapsible plastic boxes intended to contain fruit. The support elements 30, 32 do not reduce in a substantial way the useful inner dimensions of the box 20 and do not obstruct the insertion into the box of the cell-like element 72. When the boxes are empty, they can be interpenetrated to each other as shown in FIG. 4 to 7. For interpenetrating the boxes, they are arranged one above the other with the same relative orientation, i.e. so that the shorter lateral walls 24 are all placed on the same side. When two boxes. 20 with the same relative orientation are superimposed, the support elements 30, 32 of the lower box are received into the recessed portions 44, 46 of the upper box. The ribs 58 of the upper box bear on the inner edges 54 and prevent the boxes from penetrating too deeply one into the other thereby rendering difficult the subsequent separation. In addition, in the condition in which the boxes are interpenetrated, the ribs 50 rest on the bearing surfaces 38 of the lower box whereas the ribs 48 rest on the upper surfaces of the centring portions 40 (FIGS. 5, 6 and 7). When the boxes are interpenetrated, each box projects of about 40 mm from the upper edge of the lower box and penetrates for about 70 mm, which reduces the overall volume of 64%.

When the boxes contain a product, such as for example a load of fruit distributed into the seats of a proper cell-like element, the boxes are superimposed with each other without interpenetration. This is obtained by alternatively placing the boxes with opposite relative orientation. This means that, as shown in FIG. 8, in the stack of superimposed boxes the walls 24 and 26 are placed in alternated positions. For facilitating the correct superimposition of the boxes, the two walls 24, 26 may have different colours or may have easily visible features. For instance, one of the walls might have a series of holes and the other could be without holes or, as shown in FIGS. 1, 2, 5 and 9, holes 41 could be formed on the centring projection 40 of only one pair of support elements 32.

In superimposed condition, the upper box rests on the bearing surfaces 38 of the lower box. FIG. 10 shows that the bottom wall of the upper box rests on the lower box on each of the bearing surfaces 38 on the area which is comprised between the dashed line (which represents the perimeter of the bearing surface 38) and the outer edge of the bottom wall of the upper box. As shown in FIG. 10, the rib 42 and the centring portion 40 have the purpose of compensating plays and of enabling a better centring of the upper box.

The box according to the present invention could have numerous modifications and variants with respect to the embodiment shown in the figures. For example, the dimensions of the box could be varied, in particular the height of the lateral walls could be increased for enabling the superimposition of a plurality of cell-like elements or the use of lower elements. In addition, the disposition of the support elements 30 and 32 could be different from the one shown, remaining the same the fact that a first pair of support elements is arranged along a first lateral wall and a second pair of support elements is arranged along respective lateral walls orthogonal with respect to the first wall.

A further variant may consist in the addition of a pair of support elements arranged along the longer lateral walls 28 and in the vicinity of the center line of the box, but in a position slightly offset with respect to the centre, for providing a support in the central zone of the box when it is in a superimposed condition.

The box according to the invention has been designed for having walls as much as possible smooth and devoid of ribs or interstices, in order to simplify washing operations. However, if it where necessary to stiffen the bottom wall or the lateral wall, they could be provided with ribs of various type.

What is claimed is:

1. A box of plastics material comprising:

a bottom wall with a rectangular shape, from which a pair of longer lateral walls and a pair of shorter lateral walls project, a first and second pair of support elements having respective bearing surfaces, wherein the support elements of the first pair of support elements are arranged along a first lateral wall and the support elements of the second pair are arranged along respective lateral walls orthogonal with respect to the first wall, each of said support elements having a corresponding recessed portion formed on the outer side of the box and adapted to receive the homologous support element of a box of the same type when the boxes are interpenetrated, whereby the box can be interpenetrated with a box of the same type when the two boxes have the same relative orientation and can be superimposed to a box of the same type when the two boxes have opposite relative orientation, wherein each of said support elements is arranged in correspondence with a corner formed by two adjacent lateral walls, and that each of said support elements have a centering portion upwardly projecting from the respective bearing surface and defining a centered position for a superimposed box, and wherein a first rib element and a second rib element are formed in correspondence with each recessed portion and arranged such that when the boxes are interpenetrated, the first rib element of the upper box rests on the bearing surface of the lower box and the second rib element rests on the upper portion of the centering portion of the lower box.

2. A box according to claim 1, characterized in that the bearing surfaces of said support elements have an elongated shape which extends in the direction of the respective lateral wall.

3. A box according to claim 1, further comprising a plurality of ribs on said outer side, which are intended to abut on corresponding stop surfaces when the box is interpenetrated into a box of the same type.

4. The box of claim 1 further comprising an elongate support element positioned on an interior surface of a first lateral wall intermediate a bottom edge and a top edge of said first lateral wall and a plurality of ribs, said ribs being spacedly positioned along a length of an outer surface of a second lateral wall, proximate a bottom edge of said second lateral wall, wherein said ribs are oriented to abut against a said elongate support element of a second box upon said box interpenetrating said second box, wherein said ribs in conjunction with said elongate support element preclude an abutment of an outside surface of said bottom with an interior surface of a bottom of said second box upon said interpenetration.

5. The box of claim 3 wherein said ribs are positioned within a recess defined within said outer surface of said second lateral wall.

6. The box of claim 1 wherein at least two rib elements are disposed within said recessed portion.

7. The box of claim 6 wherein said at least two rib elements comprise a first said rib element having a bottom surface which is positioned elevationally below a bottom surface of a second said rib element, wherein said first rib element is positioned to abut against a said bearing surface of a second box while a bottom surface of said second rib element is positioned to abut against a said centering portion of a second box support element upon said box being interpenetrated into said second box.

8. The box of claim 7 wherein said rib elements are vertically disposed and spacedly positioned from one another.

9. The box of claim 1 wherein said first rib element is substantially parallel to and of a length different than said second rib element.

* * * * *

UNITED STATES PATENT AND TRADEMARK OFFICE

CERTIFICATE OF CORRECTION

PATENT NO. : 6,557,718 B1
DATED : May 6, 2003
INVENTOR(S) : Franco Cesano

It is certified that error appears in the above-identified patent and that said Letters Patent is hereby corrected as shown below:

Title page,
Item [73], Assignee, should read -- Sicav Sas di Militerno & C --

Signed and Sealed this

Sixth Day of January, 2004

JAMES E. ROGAN
*Director of the United States Patent and Trademark Office*

UNITED STATES PATENT AND TRADEMARK OFFICE

CERTIFICATE OF CORRECTION

PATENT NO. : 6,557,718 B1
DATED : May 6, 2003
INVENTOR(S) : Franco Cesano

It is certified that error appears in the above-identified patent and that said Letters Patent is hereby corrected as shown below:

Title page,
Item [73], Assignee, should read -- Sicav Sas di Militerni & C --

This certificate supersedes Certificate of Correction issued January 6, 2004.

Signed and Sealed this

Twenty-third Day of March, 2004

JON W. DUDAS
*Acting Director of the United States Patent and Trademark Office*